US006413335B1

(12) United States Patent
Drake, Jr.

(10) Patent No.: US 6,413,335 B1
(45) Date of Patent: Jul. 2, 2002

(54) EASY RELEASE PROCEDURE

(75) Inventor: Robert H. Drake, Jr., East Alton, IL (US)

(73) Assignee: Burlington Industries, Inc., Greensboro, NC (US)

( * ) Notice: Subject to any disclaimer, the term of this patent is extended or adjusted under 35 U.S.C. 154(b) by 0 days.

(21) Appl. No.: 09/444,409

(22) Filed: Nov. 22, 1999

(51) Int. Cl.[7] ..... E04B 15/00

(52) U.S. Cl. ..... 156/64; 156/247; 156/71; 156/94; 156/281; 156/304.7; 156/310; 156/314

(58) Field of Search ..... 156/64, 71, 94, 156/247, 281, 304.7, 310, 314; 52/403.1, 746.1; 428/95

(56) References Cited

U.S. PATENT DOCUMENTS

| | | | | |
|---|---|---|---|---|
| 4,360,554 A | * | 11/1982 | Campbell et al. | 428/91 |
| 4,797,170 A | * | 1/1989 | Hoopengardner | 156/152 |
| 5,082,705 A | * | 1/1992 | Rose | 428/40 |
| 5,116,439 A | * | 5/1992 | Raus | 156/71 |
| 5,198,277 A | | 3/1993 | Hamilton et al. | |
| 5,376,419 A | * | 12/1994 | Foster et al. | 428/40 |
| 5,501,895 A | | 3/1996 | Finley et al. | |
| 6,012,261 A | * | 1/2000 | McDonald | 52/177 |

OTHER PUBLICATIONS

The Reader's Digest Complete Do–it–yourself Manual, 1973, The Reader's Digest Association, eighteenth Printing, p. 368.*

* cited by examiner

*Primary Examiner*—Richard Crispino
*Assistant Examiner*—Sing P Chan
(74) *Attorney, Agent, or Firm*—Nixon & Vanderhye

(57) ABSTRACT

In circumstances where flooring may have a high moisture content, for example some types of concrete floors, at least one moisture sealing coating is applied to the floor to substantially preclude moisture migration from the floor, and then a first adhesive is applied over the moisture sealing coating and a scrim is applied to the first adhesive and held in place by the first adhesive. The scrim may be a layer of non-woven material that provides a surface substantially impervious to moisture. A second, carpet installation, adhesive is applied over the scrim, and commercial carpeting is laid on the second adhesive. Usually the scrim and carpeting will have seams, and the carpet installation is practiced so that the seams of the carpeting are substantially perpendicular to, or spaced at least about 6 inches from, the scrim seams. When worn the carpeting, scrim, and adhesive layers can be taken up, and the method repeated. Where a calcium chloride test of the flooring indicates a moisture reading less than 3 pounds per 1000 sq. ft. for 24 hours, the moisture sealing coating need not be applied.

19 Claims, 3 Drawing Sheets

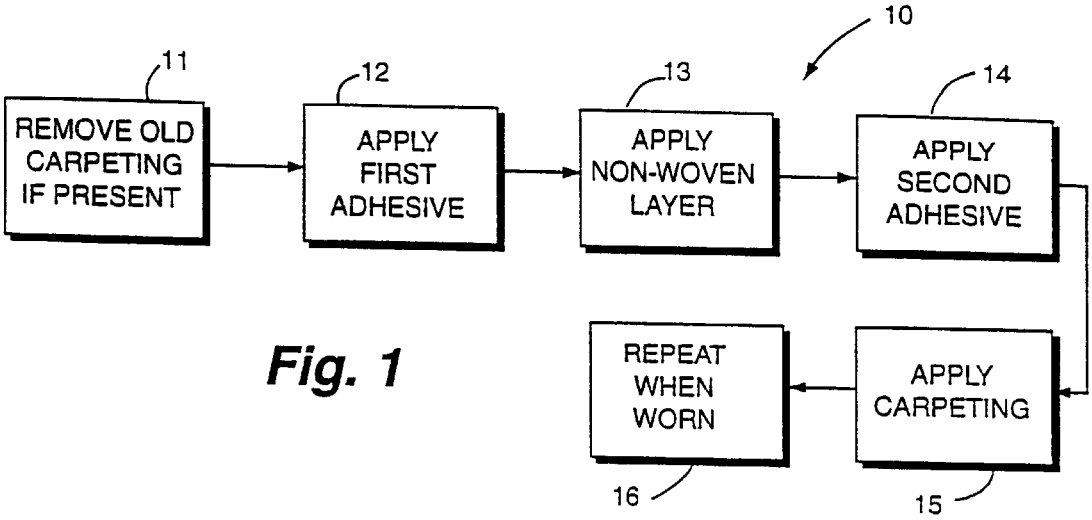
Fig. 1
Fig. 3
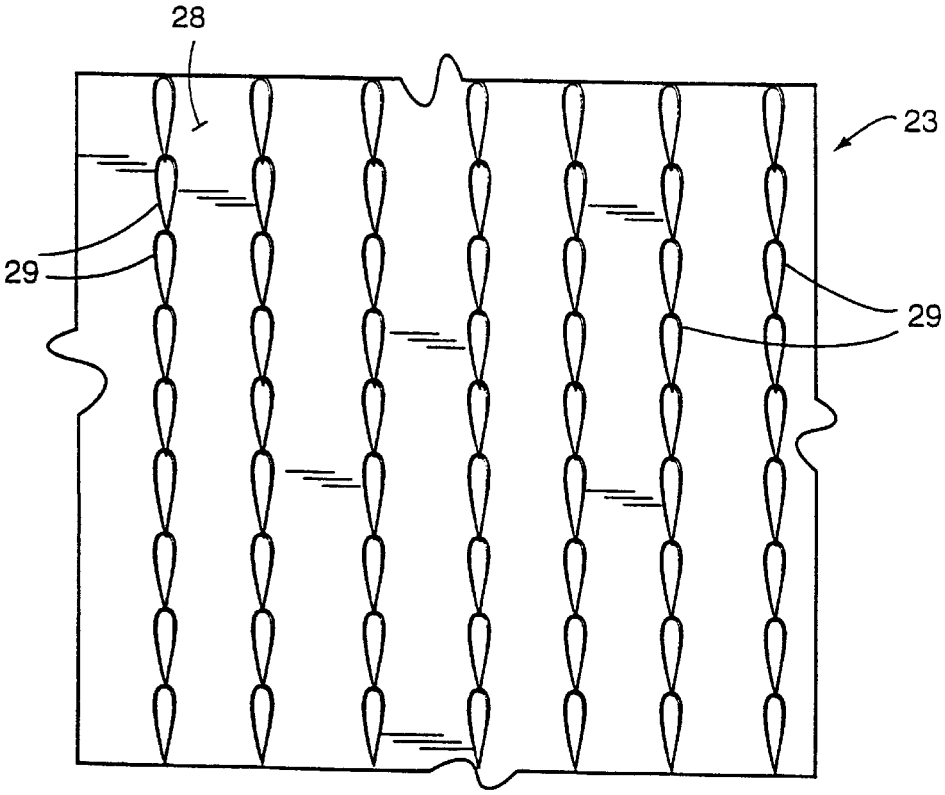

EASY RELEASE PROCEDURE

BACKGROUND AND SUMMARY OF THE INVENTION

In copending application Ser. No. 09/136,523 filed Aug. 19, 1998 (the disclosure of which is hereby incorporated by reference herein), an easy release system and method for the application of carpeting to flooring (particularly pre-existing floor coverings) is provided that is highly advantageous compared to the prior art, using commonly available components in an innovative and effective manner. According to the present invention, further enhancements of that system and method are provided which allow its ready application to base flooring (such as concrete, wood, plywood, metal, etc.) so that no floor covering initially need be provided at all. Also, the present invention utilizes a number of particularly effective techniques to enhance the probability that the installation can be done effectively, accurately, quickly, and so that the commercial carpeting applied will essentially be "permanent", that is staying in place until completely worn, at which time all of the components can be replaced and the method started again and the system utilized again.

According to one aspect of the present invention a method of installing commercial carpet over a floor is provided comprising the following: (a) Cleaning the floor. (b) If necessary, applying at least one moisture sealing coating to the floor to substantially preclude moisture migration therefrom and effecting drying of the at least one coating. (c) Laying out a scrim covering for the floor and cuffing and fitting the scrim. (d) Removing the scrim from at least portions of the floor when adhesive is to be applied and substantially uniformly applying a first adhesive to the floor or at least one moisture sealing coating thereon. (e) Applying the laid out scrim onto the first adhesive. (f) Smoothing out air bubbles from the scrim. (g) Laying out commercial carpeting over the scrim and trimming commercial carpeting. (h) Removing the carpeting from areas where adhesive is to be applied. (i) Substantially uniformly applying a second adhesive over the scrim; and (j) pressing the laid-out commercial carpeting onto the second adhesive over the scrim.

Typically (c) and (e) are practiced so that there is at least one seam in the scrim, and (g) and (j) are practiced so that there is at least one seam in the carpeting; and the method further comprises: practicing (g) and (j) so that the seams in the carpeting are either substantially perpendicular to, or offset at least about six inches from, the seams in the scrim. Also, the method preferably further comprises, between (a) and (b), (k) determining at least one of the moisture and pH of the floor, and if the moisture or pH are above a predetermined threshold, practicing (b) to apply at least one coat. That is, typically (k) is practiced using a calcium chloride test, and if the level of moisture detected is above about 3.0 pounds per 1,000 sq. ft. per 24 hours, then practicing (b) to apply at least one coat. Further, there typically is provided the further procedure (I), after (j), of finishing the seams in the carpeting, as by using a stiff hand brush.

Typically, (g) and (j) are in part practiced by edge trimming to produce a tight seam and carpeting edges; reverse-curling the carpeting edges prior to (i), and (i) may be practiced at least primarily by trowelling.

Normally after (i) the second adhesive is allowed to sit about 10–15 minutes before practicing (j). Typically, (g) is practiced to insure that tight seams are formed without compression. Also, typically (j) is practiced using a stiff bristle broom, a section of carpet tube, or an implement operatively shaped like a section of carpet tube. Still further (g) may be practiced in part by snapping a white chalk line on the scrim at a starting point near the center of a room in which the floor is located, the line substantially perpendicular to walls of the room, and using the chalk line for alignment of a first seam of the carpeting.

In order to achieve maximum effective results and longest life possible, the method typically further comprises maintaining the floor, adhesives, and carpeting at a temperature between 65° and 95° F. during, for at least about 24 hours before, and for at least about 48 hours after, the practice of (b)–(j). For example, the method further comprises substantially unrolling the carpeting and keeping it in the room where the floor is for at least about 24 hours before the practice of (b)–(j); and taking a plurality of temperature readings at different points along the floor prior to the practice of (e) to insure appropriate temperature conditions. Typically (j) is practiced in part to butt the carpeting seams tightly, without peaking. Also, typically (e) is practiced utilizing as the layer of scrim the non-woven, macroscopically smooth, substantially moisture impervious scrim disclosed in application Ser. No. 09/136,523.

According to another aspect of the present invention a method of installing commercial carpet over a floor is provided, comprising: (a) Applying at least one moisture sealing coating to the floor to substantially preclude moisture migration therefrom, and effecting drying thereof. (b) Applying a first adhesive to the at least one moisture sealing coating. (c) Applying a scrim onto the first adhesive, so that there is at least one seam in the scrim. (d) Applying a second adhesive over the scrim; and (e) laying commercial carpeting on the second adhesive over the scrim, the carpeting having at least one seam therein, and the carpeting being applied so that the seams in the carpeting are either substantially perpendicular to, or offset at least about 6 inches from, the seams in the scrim.

In the practice of the method, typically (b) is practiced to apply the first adhesive at a rate of about 40 square yards per gallon, and (d) is practiced so as to apply the second adhesive at a rate of about 5–6 sq. yd. per gallon. Also, the method typically comprises (f), after the carpeting applied in (e) is worn, taking up the worn carpeting, second adhesive, scrim, and first adhesive, and repeating at least (b)–(e).

According to another aspect of the present invention a flooring system is provided comprising the following components: A first flooring surface. At least one moisture sealing coating directly adhering to the first flooring surface. A first pressure sensitive adhesive substantially directly adhered to the at least one moisture sealing coating. A scrim applied to the first pressure sensitive adhesive and substantially directly adhered thereto. A second, carpet installation, adhesive applied to the scrim opposite the first adhesive; and carpeting adhesively secured to the second adhesive.

The details of the individual elements may be as described in said copending application Ser. No. 09/136,523, and the moisture sealing coating may comprise one or more layers of a product commercially available under the trade name "Lees Everseal", available from Burlington Industries of Greensboro N.C.

It is the primary object of the present invention to provide a method and flooring system which are highly advantageous in providing a replaceable yet "permanent" type commercial carpet installation, that may be utilized in a wide variety of circumstances, including over concrete or other base floors, or original floor coverings. This and other aspects of the invention will become clear from an inspection of the detailed description of the invention and from the appended claims.

BRIEF DESCRIPTION OF THE DRAWINGS

FIG. 1 is a box diagram of an exemplary method according to copending application Ser. No. 09/136,523;

FIGS. 3 and 4 are top and bottom plan views of an exemplary non-woven layer used in the practice of the method of FIG. 1 and utilizable according to the invention;

DETAILED DESCRIPTION OF THE DRAWINGS

Figure 2:
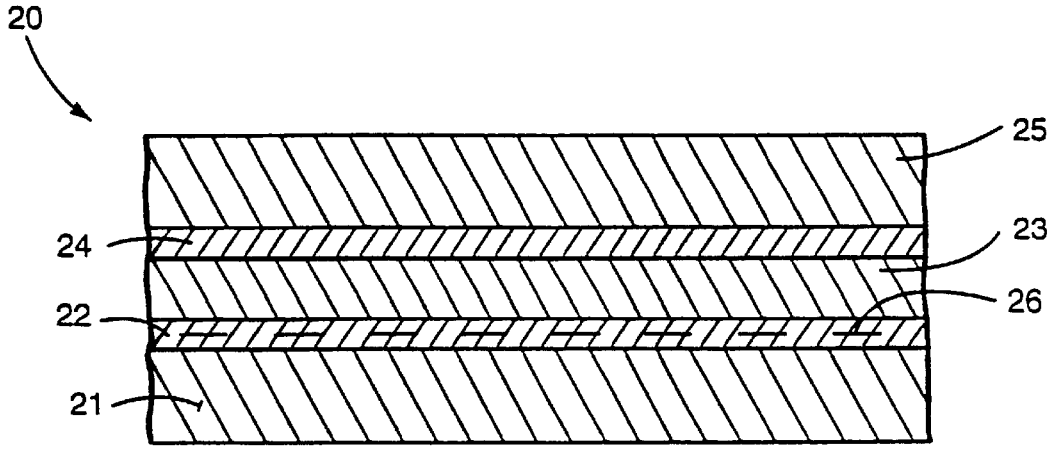
FIG. 2 is a side cross-sectional view of the flooring system produced from the method of FIG. 1.

FIG. 1 schematically illustrates, generally by reference numeral 10, a method of installing commercial carpet over a preexisting floor covering, according to the invention in copending application Ser. No. 09/136,523, and related to the method of the invention. The floor covering typically is wood, carpet tile, vinyl tile, or the like.

A first step of the method, step 11, is practiced if there is old/worn commercial carpeting that needs to be removed. After removal of the carpeting by any suitable conventional technique, a first, pressure sensitive, adhesive is applied to the preexisting floor covering as indicated at 12 in FIG. 1. The adhesive is preferably applied with a napped element, such as a paint roller, e.g. having a quarter inch nap. The pressure sensitive adhesive is preferably a latex adhesive such as is available from Burlington Industries of Greensboro N.C., under the trade name "Burlington Pressure Sensitive Adhesive". Preferably, shredded fiberglass, or a comparable strength enhancing fibrous material, is added to the adhesive. Preferably between about 2–10% (by weight), more preferably between about 5–7%, e.g. about 6%, shredded fiberglass is added to the adhesive.

The next step, 13, is applying a layer of non-woven material (e.g. scrim) which adheres to the first adhesive applied at 12, and provides a macroscopically smooth, clean surface that is substantially impervious to moisture. Preferably this step 13 is practiced by applying a creped kraft base paper with reinforcing yarns (e.g. polyester yarn). One particularly suitable material is sold under the trademark "TEXTRON" by Scott & Fyfe Limited of Fyfe, Scotland. Such a material typically has a relaxed weight of about 80–100 grams per square meter.

The next step, 14, is to apply a second adhesive over the layer applied at step 13. For example, the adhesive may be "Wet Set" water based adhesive from Lees Commercial Carpets, Greensboro N.C.

After the second adhesive application step 14 new commercial carpeting is applied over the second adhesive 15 in a conventional manner. As indicated at step 16 after the carpeting applied at 15 is worn, the worn carpeting, second adhesive, non-woven layer, and first adhesive can be taken up substantially without disturbing the underlying flooring, and the steps discussed above can be repeated.

FIG. 2 schematically illustrates an exemplary flooring system according to copending application Ser. No. 09/136,523, and related to that of the present invention, generally by reference numeral 20. The flooring system 20 includes a preexisting flooring 21 which may be wood, carpet tile, vinyl tile, or the like, with a first pressure sensitive adhesive 22 applied thereon (preferably substantially directly thereto), and with the non-woven layer 23 applied substantially directly to the first adhesive 22. The second adhesive 24 preferably is applied substantially directly to the layer 23, and the new commercial carpeting 25 is preferably applied substantially directly to the second layer of adhesive 24. FIG. 2 is schematic so that the various thicknesses of the layers are exaggerated in some cases, or minimized in others, for clarity of illustration. The optional, but preferred, reinforcing fibers for the adhesive 22 are shown schematically at 26 in FIG. 2.

FIG. 2 also shows a flooring system intermediate according to the invention comprising the floor surface defined by the flooring 21 and the pressure sensitive adhesive 22 with about 2–10% (e.g. about 5–7%) shredded fiberglass therein disposed on the floor 21, the adhesive 22 preferably being a latex adhesive.

Figure 4:
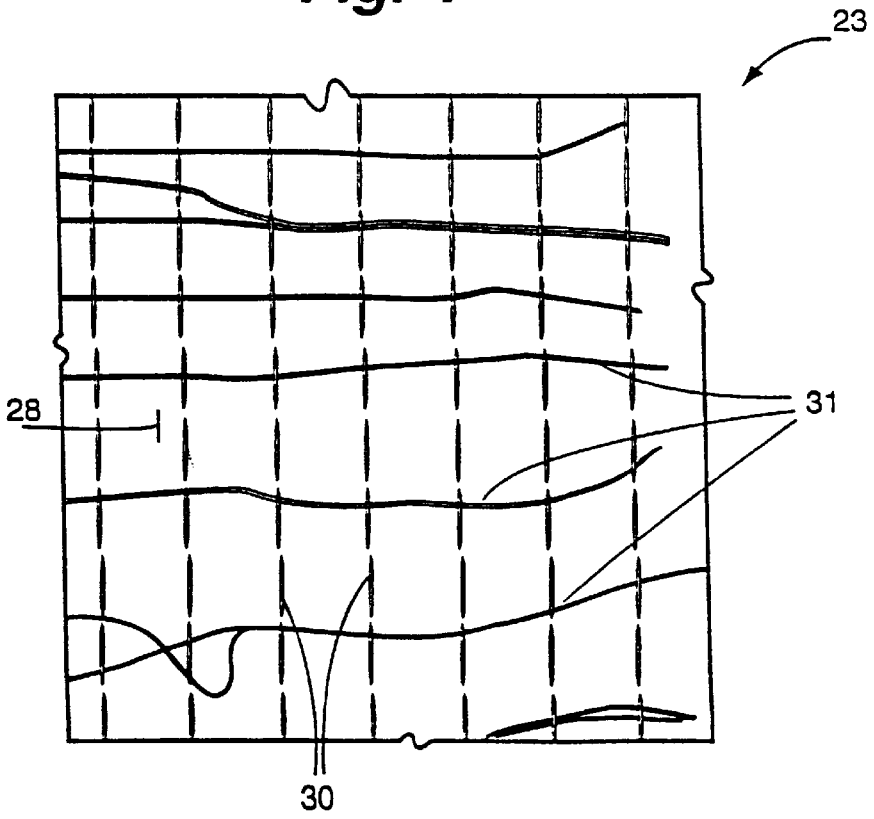

An exemplary material that forms the layer 23—namely the "TEXTRON" material described above—is schematically illustrated in top and bottom view in FIGS. 3 and 4, respectively. The non-woven layer 23 comprises creped kraft paper 28 with stitching (preferably polyester) 29 on the top face (FIG. 3), the stitching visible at 30 on the back face of FIG. 4. Weft reinforcing threads 31 are also provided, extending generally transverse to the stitching 29, 30, as seen in FIG. 4.

Figure 5:
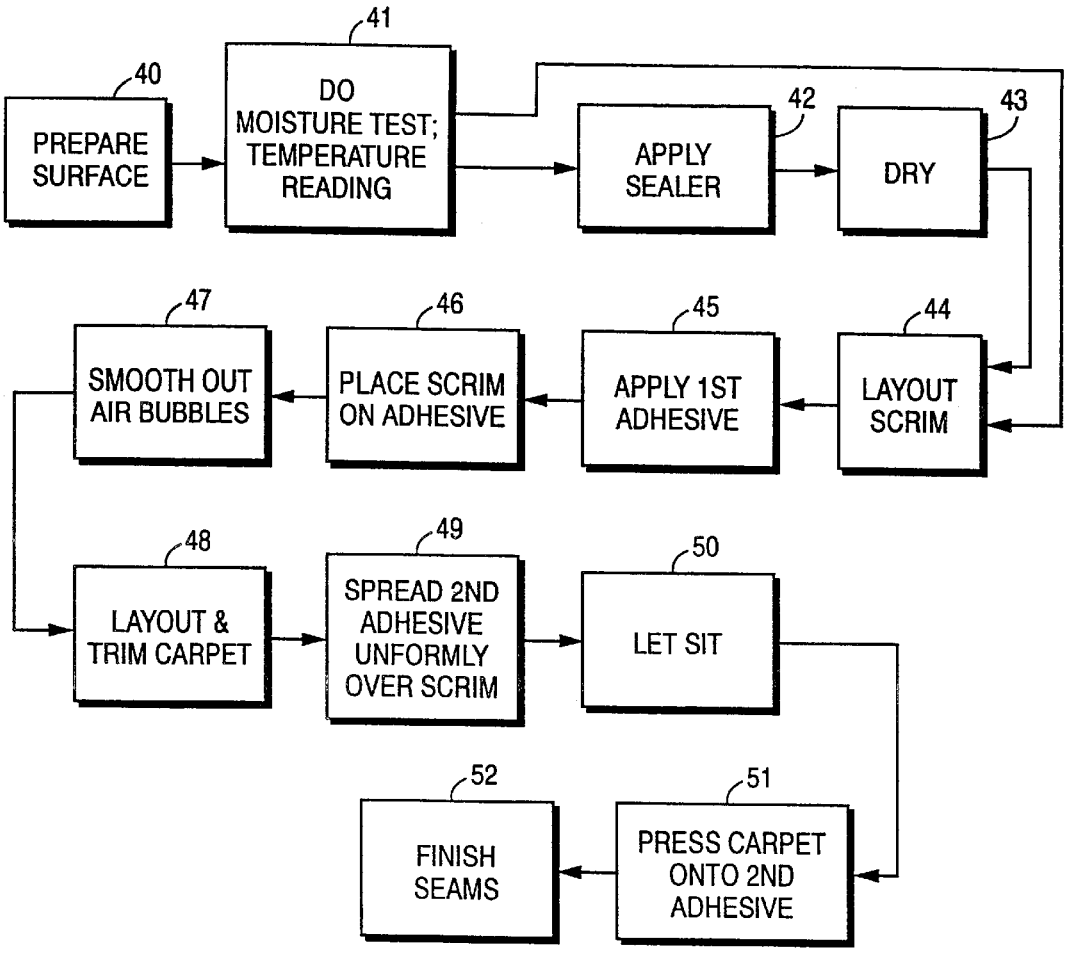
FIG. 5 is a box diagram of an exemplary method according to the present invention which is a revised and enhanced version of the method of FIG. 1.

According to the present invention a method, such as schematically illustrated in FIG. 5, for installing commercial carpeting is provided which is an enhancement of the basic method of FIG. 1. The method of FIG. 5 may be used in association with pre-existing floor coverings, such as the method illustrated in FIG. 1, or it may be used on base floorings, such as concrete, plywood, metal, or the like.

The first procedure in the method of FIG. 5 is to prepare the flooring surface, as illustrated schematically at 40 therein. Any flooring materials, such as paint, old glue, etc. should be removed by sanding, and all protrusions in the floor should be removed and sanded. Any cracks more than 1/16 inch wide should be filled with a latex-based flashing compound. Then the floor should be cleaned, such as by vacuuming to remove dust and dirt.

Since according to the invention it is desirable to know the moisture content of the floor so as to know what procedures should be followed, as indicated schematically at 41 in FIG. 5, it is desirable to conduct a moisture test. Moisture in the subfloor will interfere with the curing performance of the adhesive. The moisture test that should be utilized is the calcium chloride test. A reading of 3.0 pounds per 1000 sq. ft. for 24 hours is the maximum reading acceptable for the preferred adhesive that will ultimately be utilized according to the invention, namely Lees Squared Pressure Sensitive Adhesive, available from Burlington Industries of Greensboro N.C. For other adhesives a different moisture content may be acceptable.

When it is determined that the moisture content, evaluated from 41, is between 3.0 and 10 pounds, or when it is not practical to perform a test and moisture protection is desired, the next procedure according to the present invention—illustrated schematically at 42 in FIG. 5—is the application of at least one moisture sealing coating to the floor to substantially preclude moisture migration therefrom. The preferred sealing coating is Lees Everseal, described earlier. Where the moisture reading is very high, such as over pounds in the calcium chloride test, then a plurality of coatings with Lees Everseal, or comparable material, must be utilized, along with extra set up time.

Also, at the same time that the moisture test 41 is done it may be desirable—particularly if the floor is concrete—to do a pH test. If the alkalinity level of the concrete, using a litmus test, is pH about 9 or more, then procedure 42 should also be followed regardless of the moisture content determined in 41.

After the one or more coats of sealer are applied as indicated at 42, they are allowed to dry as indicated schematically at 43 in FIG. 5. The drying may be facilitated utilizing moving air, or like conventional techniques. In fact preferably during the entire practice of the method of the invention, and for about 48 hours afterwards, it is recommended the ventilation system in the building or like location where the floor is located be operated at maximum outdoor air flow, doors and windows should be opened, and window fans used, if possible.

The next preferred procedure, after the drying procedure 43, is the layout of the scrim, illustrated schematically at 44 in FIG. 5. Where the moisture content of the floor is 3.0 or below pursuant to the calcium chloride test, then the procedures 42, 43 may be skipped if desired.

The scrim layout procedure 44 is desirable to insure that the scrim is ready to be installed quickly and efficiently after a first coat of adhesive has been applied. The scrim utilized is preferably that described above and illustrated in FIGS. 3 and 4, although other scrims may be utilized especially when the moisture sealing coatings have been applied as indicated at 42 in FIG. 5.

During the procedure 44, typically the scrim is laid out in the lengths possible with consideration for traffic patterns and seam placement. The scrim is then cut. While the scrim may then be completely removed, typically it can just be folded back and the next procedure—the first adhesive application—may be initiated.

The first adhesive application schematically illustrated at 45 is typically substantially the same as the procedure 12 illustrated in FIG. 1. Preferably the pressure sensitive adhesive, such as a Lees Squared Pressure Sensitive Adhesive, is applied to the floor or the moisture sealing coating(s) using a short nap paint roller. The spread rate for the adhesive procedure 45 is about 40 square yards per gallon, the goal is to coat the floor with a continuous thin film of adhesive, that is one that is substantially uniform. A thick film will make it harder to remove the carpet from the floor at the end of the carpet service life.

The next procedure—illustrated at 46 in FIG. 5—is to place the scrim on the adhesive. This is done manually, and the scrim position is adjusted so that there are no gaps at the seam and essentially full contact is made between the scrim and the adhesive. Desirably—as illustrated schematically at 47 in FIG. 5—air bubbles are smoothed out. This may be accomplished utilizing any suitable tool for that purpose, for example even tools as simple as a two foot length of carpet core, or the bottom of a tool box shelf. The procedure 46 is comparable to the procedure 13 illustrated in FIG. 1

Next the method according to the present invention contemplates layout and trim of the carpeting, as schematically illustrated at 48 in FIG. 5. The carpeting should be roughly located so that the carpet seams will be either substantially perpendicular to the seams of the scrim, or offset at least about 6 inches to either side. All the carpet seam edges should be trimmed with appropriate conventional seam cutting tools. Layout may be facilitated by—from the starting point near the center of the room—snapping a white chalk line on the scrim (or this may be even done on the underlying flooring if the scrim and other coatings are transparent), and measuring from the perpendicular walls of the room containing the floor. The chalk line marks the location of the first seam. The carpet should then be dry laid by overlapping the edges about 1½ inches over the chalk line, and allowing an extra 1½ inches at the walls for trimming. The carpet should be checked for the direction of the pile lay, being careful to keep the carpet going in the same direction. Typically directional arrows are provided on the back of the carpet which facilitate this.

To start a seam, the installer should select one edge for cutting and fold the other side out of the way. Typically the factory edges should be trimmed off when making a seam, and the double cut method should not be utilized. To make a clean straight cut for the length of the seams, the following procedure may be utilized for straight row constructions: (a) Utilizing a screwdriver or like instrument, or the tip of a cushion back cutter, separate the yarn and visibly open a row approximately one inch from the edge. (b) Cut along the opening with a cushion back cutter, working down the entire length of the first piece of carpet. (c) To obtain a tight seam, cut close to the main body by trimming with the blade close to the seam edge, and being sure to hold the cutter straight up and down. And (d) to insure a well fitted seam, use the trace cut method to cut the second carpet edge.

To make a clean, straight cut for butt seams, one may use the following procedure for staggered or shifted row constructions: (a) Working from the back of the carpet snap a chalk line down the length of the carpet about one inch from the edge. (b) Then using a straight edge and knife to carefully cut along the line, cut through the backing and the primary back, while avoiding cutting an excess of face yarn. Then (c) trace cut the seam edge of the second carpet butting from the face or use the straight edge method and cut from the back side. In any event, preferably the first trimmed edge should be positioned along the chalk line applied over the scrim. Then after positioning the second edge against the first, check the alignment; both edges should lay flat and fit together to form a tight seam without compression.

Once the seam edges fit correctly, it is desirable to weight, or stay-nail, the center line of both carpets lengthwise to prevent the carpet from shifting. One should carefully fold both breadths of carpet, being careful not to shift the carpet. Then the carpet should be checked at the seam for height variation and corrected to level its appearance if necessary.

While the above procedure will be applicable to most installations, when installing pattern carpets a perfect match at the seams may not always be possible.

The next procedure, as illustrated schematically at 49 in FIG. 5, and corresponding to the procedure 14 in FIG. 1, is to apply the second adhesive. Preferably the procedure 49 is practiced utilizing a U-notched trowel, for example ⅛ inch by 1/16 by ⅛ inch. The proper notch size should be maintained throughout installation, and the adhesive should be spread uniformly over the scrim with the selected trowel, typically at a rate of about 5–6 square yards per gallon. Trowels are carefully calibrated measuring devices and should be properly chosen and maintained during the installation procedure. The preferred second adhesive is Lees Wet Set Adhesive, available from Burlington Industries of Greensboro N.C., or the equivalent. Of course, the procedure 49 is practiced after the carpeting has been removed, either completely removed, or at least partially peeled back with the adhesive applied section by section.

In the preferred method of the invention—as illustrated schematically at 50 in FIG. 5—it is desired to let the second adhesive set open for about 10–15 minutes before putting the carpeting down. As illustrated schematically at 51 in FIG. 5, the next procedure is the carpet application, generally comparable to the procedure 15 illustrated in FIG. 1. That is the carpeting is pressed into the adhesive, for example with a stiff bristle broom, a section of carpet tube, or an implement comparable to a carpet tube section. During the procedure 51 the installer should butt the seams tightly, although peaking should be avoided. After effective installation, with the carpet seams substantially perpendicular to or spaced at least 6 inches from the scrim seams, then the seams may be finished as illustrated schematically at 52 in FIG. 5. For example, the seams may be finished by brushing with a stiff hand brush, and trimming any protrusions with napping shears.

During the carpet seam formation procedures, it is desirable to use a suitable edge trimming technique that will produce a tight seam. Typically after cutting the seam, one should reverse-curl the edges prior to putting the carpeting into the adhesive. Also, the cross seam area should be folded back to the area where the adhesive has already been spread, and then the carpeting laid back down at the seam area. The edges may curl slightly, and if this happens one can allow about 45 minutes for the adhesive to develop more tack, and then re-roll the seam.

After installation the carpet edges should be protected with a vinyl or metal strip fastened securely to the floor, and the installation should be protected from heavy traffic for about 24 hours. Typically plastic film or sheeting should not be used as carpet protection because it retards adhesive curing. If furniture will be rolled over the installation, plywood or masonite sheets should be used to protect the carpeting.

Prior to and during the practice of FIG. 5, it is highly desirable to maintain proper environmental conditions, particularly temperature. The temperature in the room, and at the floor, should be between 65–95° F. at least from about 24 hours prior to installation, and at least about 48 hours after installation, as well as during installation. It is also desirable to store the first and second adhesive, the sealer if utilized, and the carpeting on site so that they all achieve the same equilibrium temperature between 65–95° F. The carpet may be substantially laid out while being stored (that is unrolled in the room) for maximum effectiveness. Constant temperature and humidity conditions should be maintained for at least about 24 hours before installation with the carpeting unrolled.

Figure 6:
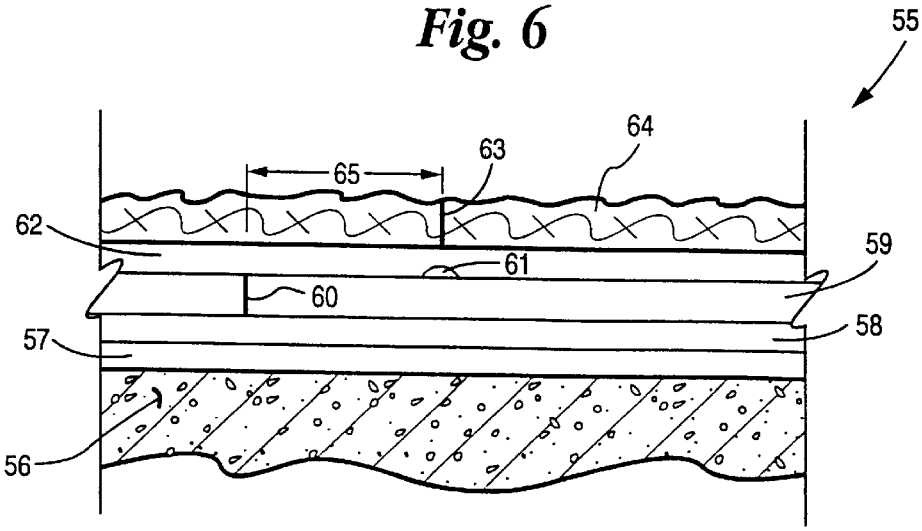
FIG. 6 is a side schematic cross-sectional view of an exemplary flooring system according to the present invention, made according to the method of FIG. 5.

FIG. 6 schematically illustrates in cross section an exemplary flooring system according to the present invention produced by practicing the method of FIG. 5. In the system 55 illustrated in FIG. 6, the flooring 56 (illustrated as concrete, but other flooring materials are of course suitable) has had one coat 57 of a moisture sealing material applied thereto after cleaning of the floor 56. The first adhesive coat 58 is applied over the moisture sealing coat 57, and then the scrim 59 is applied over the adhesive 58. Note the seam 60 in the scrim 59. The chalk line (which typically would not be visible in the final product of course) is schematically illustrated at 61 in FIG. 6, and it is assumed that the first carpet seam 63 of carpet 64 is applied thereover and attached to the second adhesive layer 62. The seams 60, 63 are offset a distance 65, which is at least about 6 inches. Alternatively the seams 60, 63 may be substantially perpendicular to each other.

As with the procedure of FIG. 1, the procedure illustrated in FIG. 5 may be repeated after the carpeting 64 wears out, in which case at least the carpeting 64 and the coating/layers 58 through 62 are removed, and the procedure started over but without the coating procedure 42, if it is still effective.

It will thus be seen that according to the present invention an advantageous method and flooring system have been provided, particularly for facilitating replaceable "permanent type" commercial carpeting. While the invention has been herein shown and described in what is presently conceived to be the most practical and preferred embodiment thereof, it will be apparent to those of ordinary skill in the an that many modifications may be made thereof within the scope of the invention, which scope is to be accorded the broadest interpretation of the appended claims so as to encompass all equivalent methods and systems.

What is claimed is:

1. A method of installing commercial roll carpet over a floor comprising substantially sequentially:

(a) cleaning the floor;

(b) if necessary, applying at least one moisture sealing coating to the floor to substantially preclude moisture migration therefrom and effecting drying;

(c) laying out a non-woven scrim covering for the floor and cutting and fitting the scrim;

(d) removing the scrim from at least portions of the floor where a first pressure sensitive adhesive is to be applied and substantially uniformly applying the first pressure sensitive adhesive to the floor or to the at least one moisture sealing coating thereon;

(e) applying the laid out scrim onto the first adhesive;

(f) smoothing out air bubbles from the scrim;

(g) laying out commercial roll carpeting over the scrim and trimming the commercial carpeting;

(h) removing the carpeting from areas where adhesive is to be applied;

(i) substantially uniformly applying a second adhesive over the scrim; and (j) pressing the laid-out commercial roll carpeting onto the second adhesive over the scrim.

2. A method as recited in claim 1 wherein (c) and (e) are practiced so that there is at least one seam in the scrim, and (g) and (j) are practiced so that there is at least one seam in the carpeting; and further comprising practicing (g) and (j) so that the seams in the carpeting are either substantially perpendicular to, or offset at least about six inches from, the seams in the scrim.

3. A method as recited in claim 2 further comprising (I), after (j), finishing the seams in the carpeting with napping shears and a stiff hand brush.

4. A method as recited in claim 2 wherein (g) and (j) are in part practiced by edge trimming to produce a tight seam and carpeting edges; and reverse-curling the carpeting edges prior to (i).

5. A method as recited in claim 4 wherein (i) is practiced at least primarily by trowelling.

6. A method as recited in claim 2 wherein (g) is practiced to insure that tight seams are formed without compression.

7. A method as recited in claim 2 wherein (g) is practiced in part by snapping a chalk line on the scrim at a starting point near the center of a room in which the floor is located, the line substantially perpendicular to walls of the room, and using the chalk line for alignment of a first seam of the carpeting.

8. A method as recited in claim 2 wherein (j) is practiced in part to butt the carpeting seams tightly without peaking.

9. A method as recited in claim 1 further comprising, between (a) and (b), (k) determining at least one of the moisture and pH of the floor, and if the moisture or pH are above a predetermined threshold, practicing (b) to apply at least one coat.

10. A method as recited in claim 9 wherein (k) is practiced using a calcium chloride test, and if the level of moisture detected is above about 3.0 pounds per 1,000 sq. ft. per 24 hours, then practicing (b) to apply at least one coat.

11. A method as recited in claim 1 further after (i) allowing the second adhesive to sit about 10–15 minutes before practicing (j).

12. A method as recited in claim 1 wherein (j) is practiced using a stiff bristle broom, a section of carpet tube, or an implement operatively shaped like a section of carpet tube.

13. A method as recited in claim 1 further comprising maintaining the floor, adhesives, and carpeting at a temperature between 65° and 95° F. during, for at least about 24 hours before, and about 48 hours after, the practice of (b)–(j).

14. A method as recited in claim 13 further comprising substantially unrolling the carpeting and keeping it in the room where the floor is for at least about 24 hours before the practice of (e)–(j).

15. A method as recited in claim 13 further comprising taking a plurality of temperature readings at different points along the floor prior to the practice of (b) to insure appropriate temperature conditions.

16. A method as recited in claim 1 wherein (e) is practiced to apply a layer of non-woven scrim which provides a macroscopically smooth clean surface that is substantially impervious to moisture.

17. A method of installing commercial roll carpet over a floor comprising:

(a) applying at least one moisture sealing coating to the floor to substantially preclude moisture migration therefrom, and effecting drying thereof;

(b) applying a first pressure sensitive adhesive to said at least one moisture sealing coating;

(c) applying a non-woven scrim onto the first pressure sensitive adhesive, so that there is at least one seam in the scrim;

(d) applying a second adhesive over the scrim; and (e) laying commercial roll carpeting on the second adhesive over the scrim, the carpeting having at least one seam, and the carpeting being applied so that the seams in the carpeting are either substantially perpendicular to, or offset at least about 6 inches from, the seams in the scrim.

18. A method as recited in claim 17 wherein (b) is practiced to apply the first adhesive at a rate of about 40 square yards per gallon, and wherein (d) is practiced so as to apply the second adhesive at a rate of about 5–6 sq. yd. per gallon.

19. In a method as recited in claim 17 further comprising (f), after the carpeting applied in (e) is worn, taking up the worn carpeting, second adhesive, scrim, and first adhesive, and repeating (b)–(e).

* * * * *